US007300220B1

(12) United States Patent
Bakker

(10) Patent No.: US 7,300,220 B1
(45) Date of Patent: Nov. 27, 2007

(54) HAND-SEPARABLE RIBBON SPOOL ASSEMBLY

(75) Inventor: Johan P. Bakker, Livingston, MI (US)

(73) Assignee: Unisys Corporation, Blue Bell, PA (US)

( * ) Notice: Subject to any disclaimer, the term of this patent is extended or adjusted under 35 U.S.C. 154(b) by 198 days.

(21) Appl. No.: 11/042,433

(22) Filed: Jan. 25, 2005

(51) Int. Cl.
*B65H 75/18* (2006.01)
*B41J 33/16* (2006.01)

(52) U.S. Cl. ..... 400/236; 400/236.2; 400/242; 400/693.1; 242/609.1; 242/611.1

(58) Field of Classification Search ..... 400/207, 400/208, 208.1, 236, 236.2, 242, 243, 693.1, 400/223, 225; 242/607, 608.6, 609, 609.1, 242/609.2, 609.3, 611, 611.1, 596.7, 596.1, 242/596.2, 598, 598.3, 598.4, 599, 599.1, 242/599.3
See application file for complete search history.

(56) References Cited

U.S. PATENT DOCUMENTS 3,432,021 A * 3/1969 Morelli ..... 400/227
4,629,136 A * 12/1986 Vallance ..... 242/608.6
5,238,198 A * 8/1993 Jingu et al. ..... 242/532.7
5,352,900 A * 10/1994 Dragon et al. ..... 250/559.36
5,599,115 A * 2/1997 Radcliffe et al. ..... 400/207

* cited by examiner

*Primary Examiner*—Leslie J. Evanisko
(74) *Attorney, Agent, or Firm*—Richard J. Gregson; Brooks Kushman P.C.

(57) ABSTRACT

A hand-separable ribbon spool shaft assembly adapts a plain ribbon spool so as to provide drive and location functions. The shaft assembly is composed of at least two shaft parts that are assembled to the ribbon spool and cooperate to provide a manual hand-action locking mechanism. First and second ends of the shaft assembly provide bearing and locating surfaces when the shaft assembly is positioned in a printer. The bearing and locating services allow the ribbon spool shaft assembly to rotate during operation of the printer, and the assembly further includes a gear drive means for driving the rotating ribbon spool.

9 Claims, 8 Drawing Sheets

HAND-SEPARABLE RIBBON SPOOL ASSEMBLY

BACKGROUND OF THE INVENTION

1. Field of the Invention

The invention relates to offset print ribbon such as, for example, high-speed magnetic ink character recognition (MICR) encoding ribbon. One particular offset print ribbon is provided in precut spools of about diameter 4.5 inches and width 2.5 inches, wound onto a low-cost plastic spool core and slit to width.

2. Background Art

For use in high-speed encoding printers, such as those used in certain document processing systems, offset print ribbon needs to be accurately located (to make sure that the ribbon stays straight and tracks correctly through a print mechanism), positively driven/retarded (to allow ribbon to be rapidly advanced between print cycles). By the nature of the ribbon (offset magnetic ink on a polypropylene substrate), the ribbon cannot be driven by any friction means acting on either ribbon web surface, either before or after printing. Further, the offset print ribbon needs to be quickly replaceable by operators with limited training and without tools, capable of being installed only in the one correct orientation, and of the lowest possible cost.

Existing approaches to using offset print ribbon in high-speed encoding printers have shortcomings.

For the foregoing reasons, there is a need for an improved ribbon spool assembly.

SUMMARY OF THE INVENTION

It is an object of the invention to provide an improved hand-separable ribbon spool assembly for use in a high-speed encoding printer.

In carrying out the invention, a hand-separable spool shaft assembly adapts a plain ribbon spool to provide drive and location functions. The hand-separable function is preferably provided by a push-and-turn function built into a two-piece shaft assembly which allows the shaft assembly to be separated into two parts, which are assembled to the plain ribbon spool, then locked together, all by hand action without tools.

The shaft locates the ribbon spool radially and in all three axes of translation, and provides the necessary bearing and locating surfaces to position the ribbon spool correctly in a printing mechanism. The shaft allows the ribbon spool to rotate to unwind/rewind correctly, and provides gear drive means to drive/retard the rotating ribbon spool.

In the preferred two-piece shaft assembly, spring means enclosed within one of the two shaft parts provides both the locking force for the push-and-turn function and the necessary lateral force to clamp the two shaft halves onto the ribbon spool to eliminate lateral tolerance variations.

Further, in the preferred two-piece shaft assembly, keying and locational features built into the other shaft part provide positive one-way-only assembly function. In this aspect of the invention, any attempt to assemble the ribbon spool in other than the correct orientation, or any incomplete assembly, will result in an assembly which cannot be completed and/or will not go into the printer mechanism for which it is designed.

DETAILED DESCRIPTION OF THE PREFERRED EMBODIMENT

Figure 1:
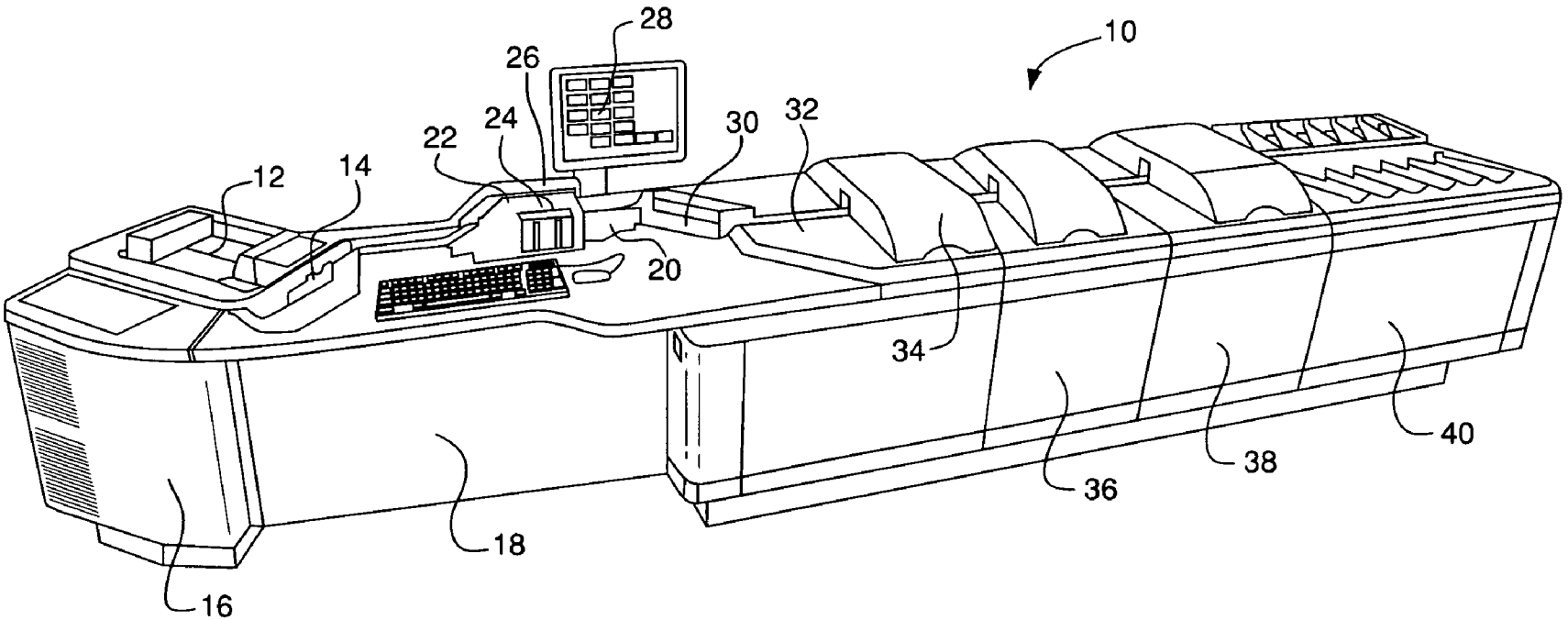
FIG. 1 illustrates a document processing system made in accordance with the invention.
Figure 2:
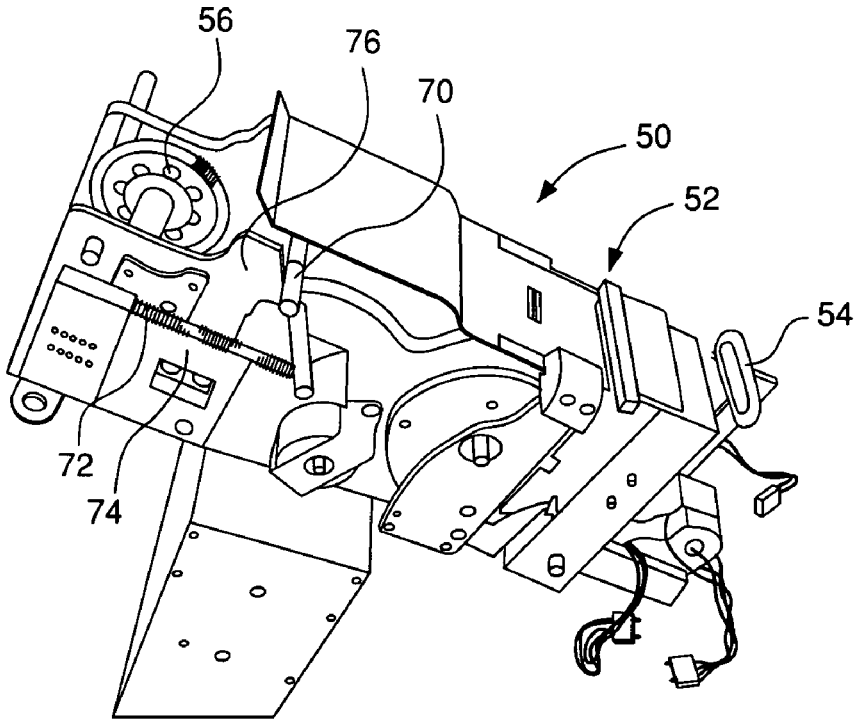
FIG. 2 is a perspective view of a printing mechanism including a ribbon spool lock assembly holding a pair of hand-separable ribbon spool shaft assemblies made in accordance with the invention.
Figure 3:
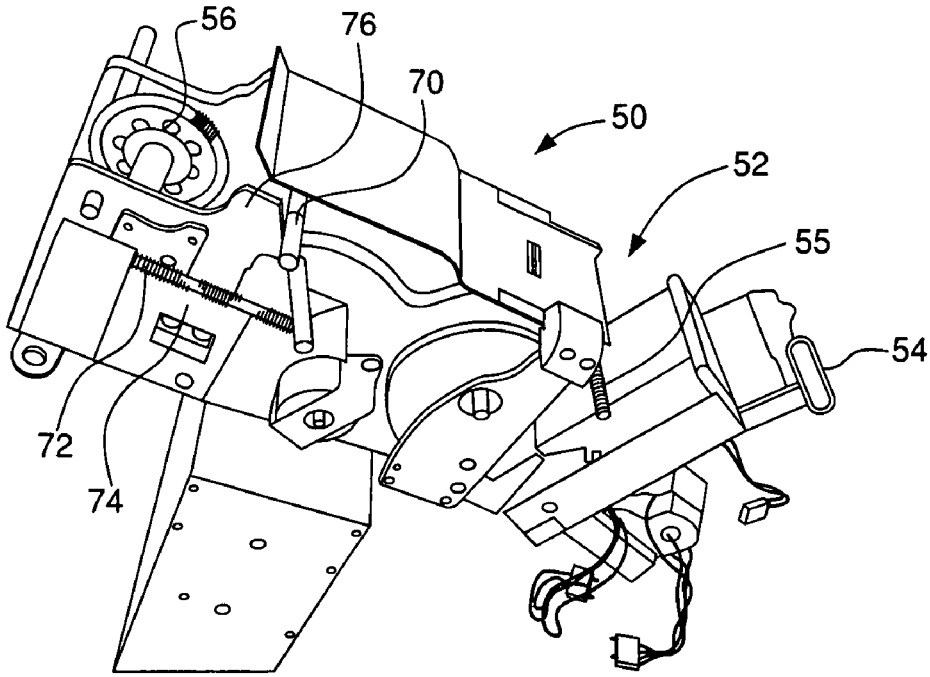
FIG. 3 is another perspective view of the printing mechanism, with the document path opened.
Figure 4:
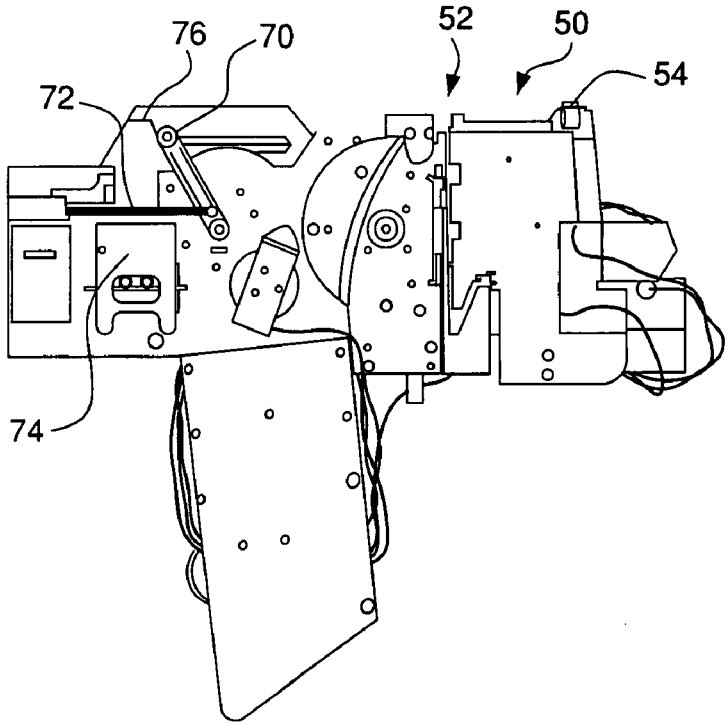
FIG. 4 is a side view of the printing mechanism.
Figure 5:
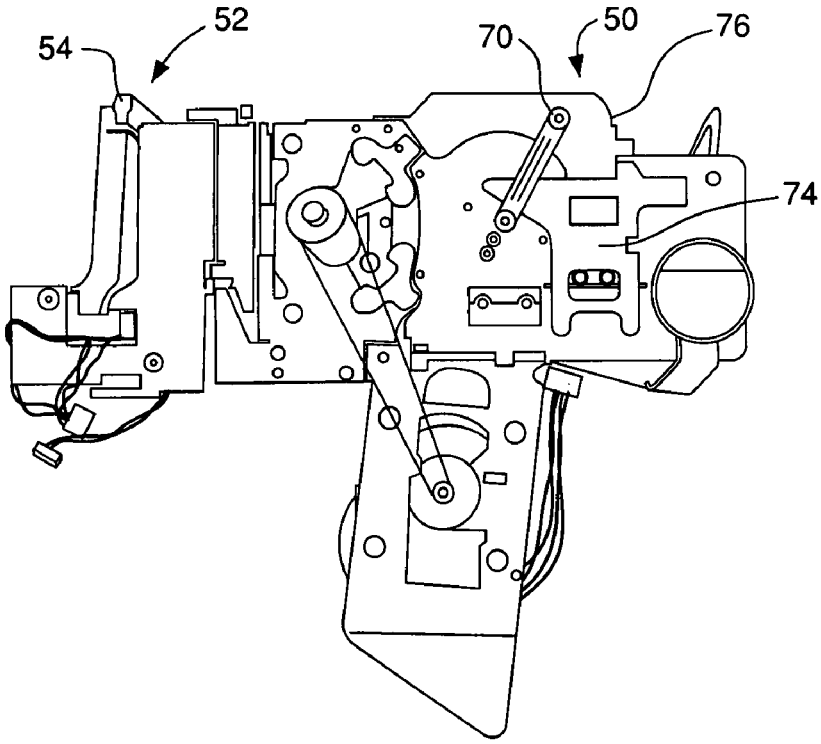
FIG. 5 is a back side view of the printing mechanism.
Figure 6:
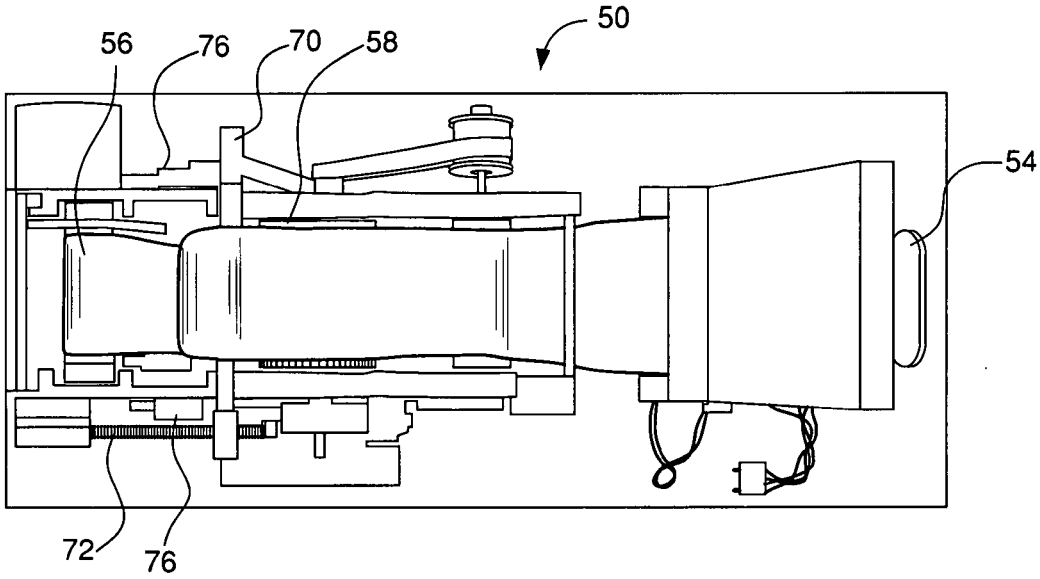
FIG. 6 is a top view of the printing mechanism, with the cover opened.

FIG. 1 illustrates a document processing system for feeding and transporting documents at 10. System 10 includes a primary feeder 12 and a secondary feeder 14. Cabinet 16 houses a computer running software for system 10. System 10 further includes removable kneewell panel 18. The feeders act to separate and feed documents singly, in order, from a stack. The remainder of the system is the transporting portion of the system, which includes a number of roller pairs and/or belts to convey the documents, one at a time, through a track past other processing devices that perform operations on the documents.

As shown in FIG. 1, a number of processing devices are located in the transporting portion of the system 10. Magnetic ink character recognition (MICR) reader 20 and optical character recognition (OCR) reader 22 are located in the document track following secondary feeder 14. As well, upstream imaging devices 24 and 26 image each passing document. The operator display is indicated at 28.

With continuing reference to FIG. 1, system 10 further includes a post-read view station 30, and a low-speed document encoder 32. As well, a multi-jet endorser (MJE) is located at 34. Further down the document track, an amount-only or full-field high-speed encoder 36 and downstream imager 38 process the passing documents. Finally, a 12-pocket stacker module 40 is provided for the actual sorting of the documents into pockets. The drawings illustrate the preferred embodiment, which is depicted as an NDP Quantum Series transport available from Unisys.

In accordance with the invention, system 10 may incorporate a printing mechanism including the improved ribbon spool lock assembly. For example, encoder 32 or encoder 36 could include a printing mechanism including the improved ribbon spool lock assembly.

In accordance with the invention, the printing mechanism may take a variety of forms. FIGS. 2-12 illustrate a preferred embodiment of the printing mechanism. As best shown in FIGS. 2-6, the printing mechanism is generally indicated at 50. Documents being processed by the system travel down a document path that passes through printing mechanism 50 at 52. As shown, release lever 54 opens the document path, and the printing impact elements are indicated at 55.

Printing mechanism 50 is equipped with a pair of ribbon spools 56 and 58. Print mechanism 50 requires that the ribbon spools 56 and 58 be locked in position radially when print mechanism 50 is functioning. The locking function is provided by a positive radial spool lock which must be opened by some operator interaction when ribbon is to be replaced.

Printing mechanism 50 also includes a pivoting ribbon tension arm 70. Tension arm 70 applies tension to the ribbon for printing-related purposes. Tensioner arm 70 must be pivoted out of its normal operating position when ribbon is to be replaced, and held out of position during the replacement process, yet it must be returned to the normal operating position before normal printing recommences. Spring mechanism 72 biases tension arm 70.

Figure 11:
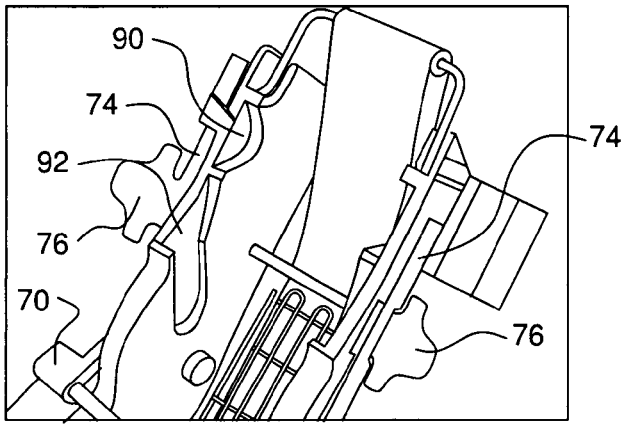
FIG. 11 illustrates the printing mechanism with the spools removed, showing the radial path for loading/unloading the spools.
Figure 12:
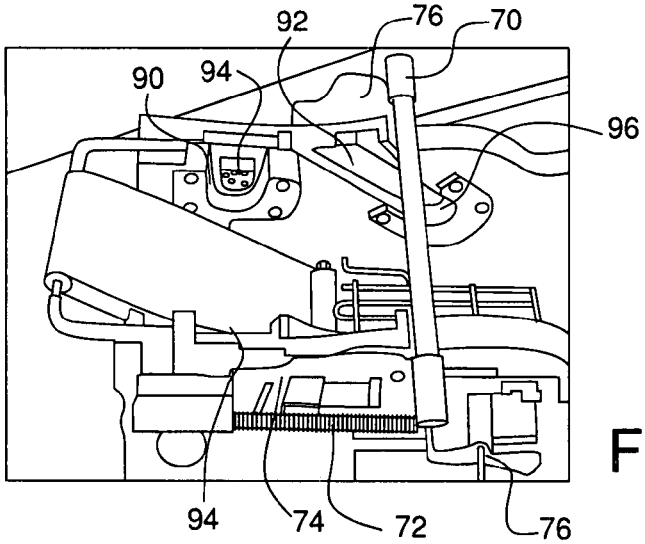
FIG. 12 is another view of the printing mechanism with the spools removed, with the locking plates in the locked positions and the tension arm in the normal operating position to illustrate the locking features protruding into the printing mechanism which radially lock the ribbon spools when the spools are present.

A pair of locking plates 74 are built into the sides of printer mechanism 50. Locking plates 74 include locking features which protrude into printing mechanism 50 in such a way as to radially lock the ribbon spools in their correct position for printing. FIGS. 11 and 12 illustrate slots 90 and 92 for receiving ribbon spools, and locking features 94 and 96 that provide the positive radial spool lock.

Locking plates 74 are pivoting to a released position by means of an opposed pair of cam latches 76. Cam latches 76 are designed to be operated with the operator's fingers. When locking plates 74 are in the released positions, locking features 94, 96 are withdrawn from the ribbon spools, allowing them to be removed.

Locking plates 74 are further configured and shaped with additional features which are interlocked with the pivoting ribbon tensioner arm 70. This prevents locking plates 74 from being pivoted into the released positions until the ribbon tensioner arm 70 has been manually pressed into the correct position for ribbon loading. Only when the tensioner arm 70 is held in the correct position for ribbon loading can the locking plates 74 be placed in the released positions and the ribbon spools removed. Additionally, once locking plates 74 are placed in the released positions, other features on the locking plates engage the tensioner arm 70 and hold it in the ribbon loading position.

Figure 7:
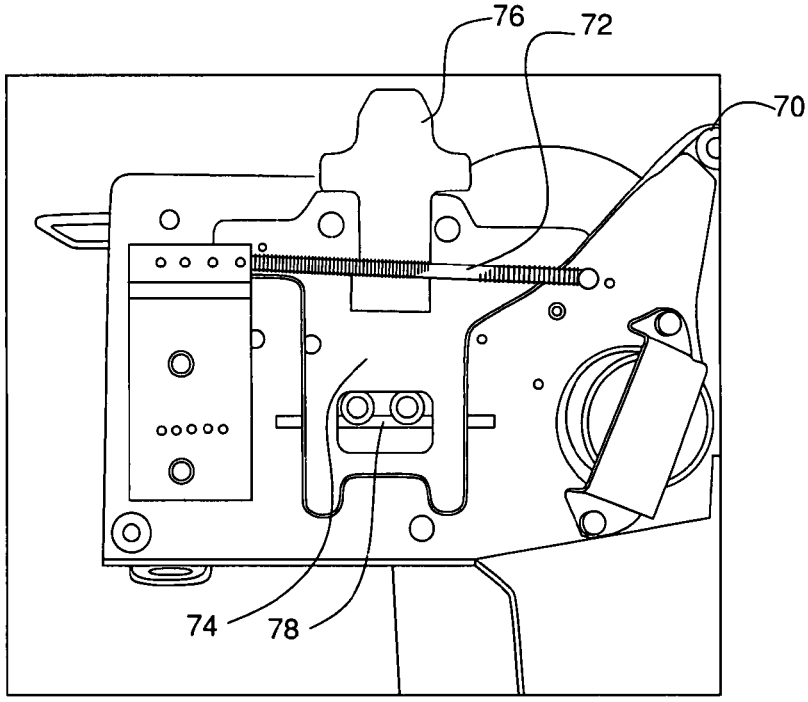
FIG. 7 is a view of one side of the ribbon spool lock assembly with the tension arm moved out of its normal operating position into a ribbon loading position.
Figure 8:
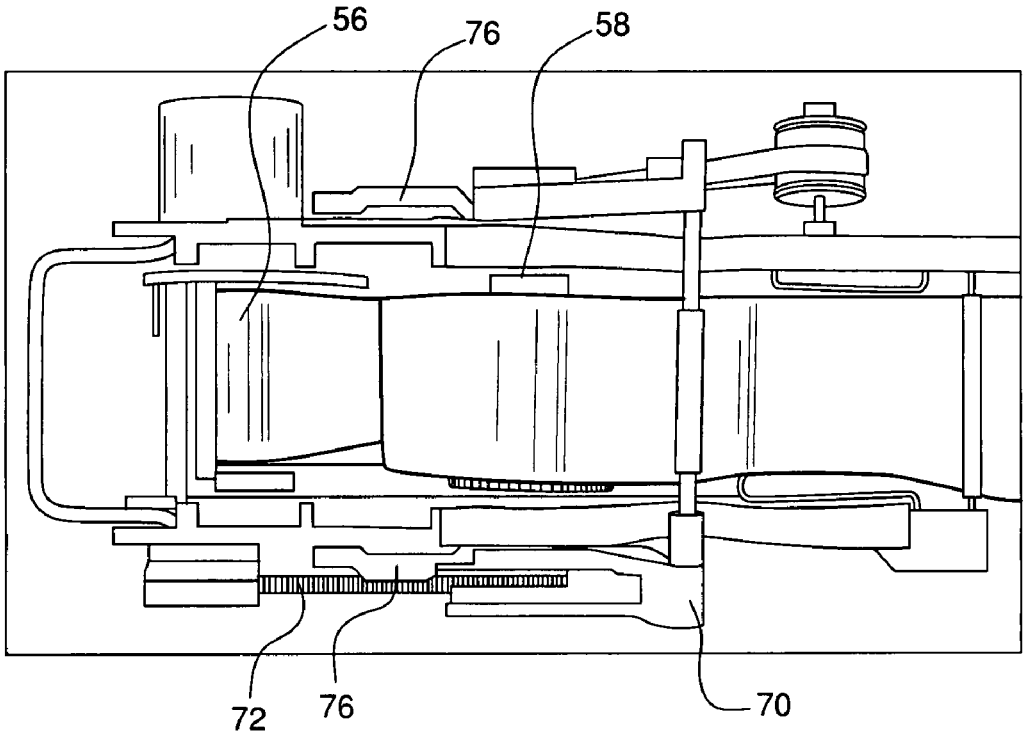
FIG. 8 is a top view of the printing mechanism with the tension arm moved out of its normal operating position into the ribbon loading position.
Figure 9:
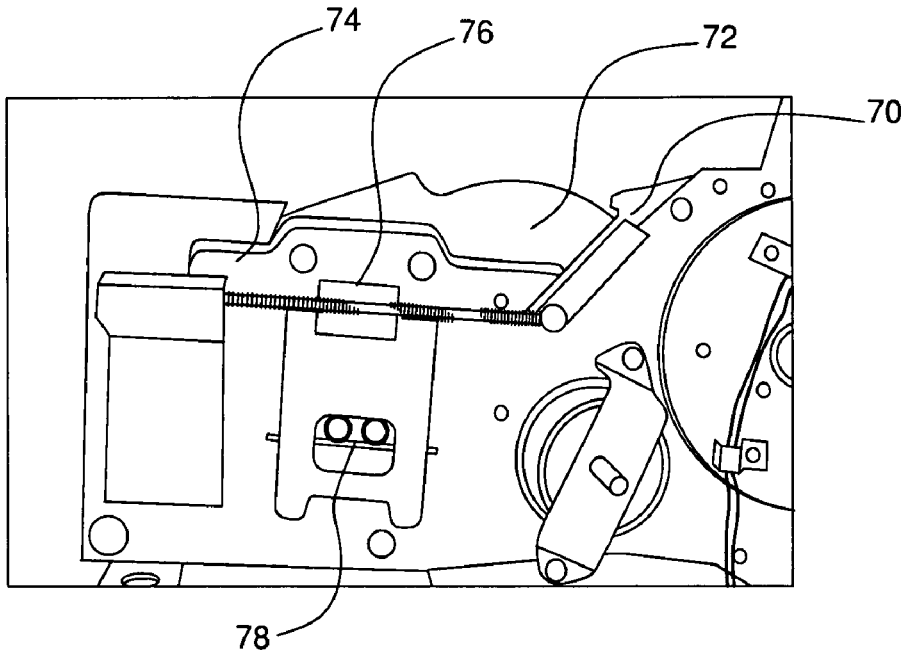
FIG. 9 is a view of one side of the ribbon spool lock assembly with the tension arm in the ribbon loading position, and the locking plate in the unlocked position.
Figure 10:
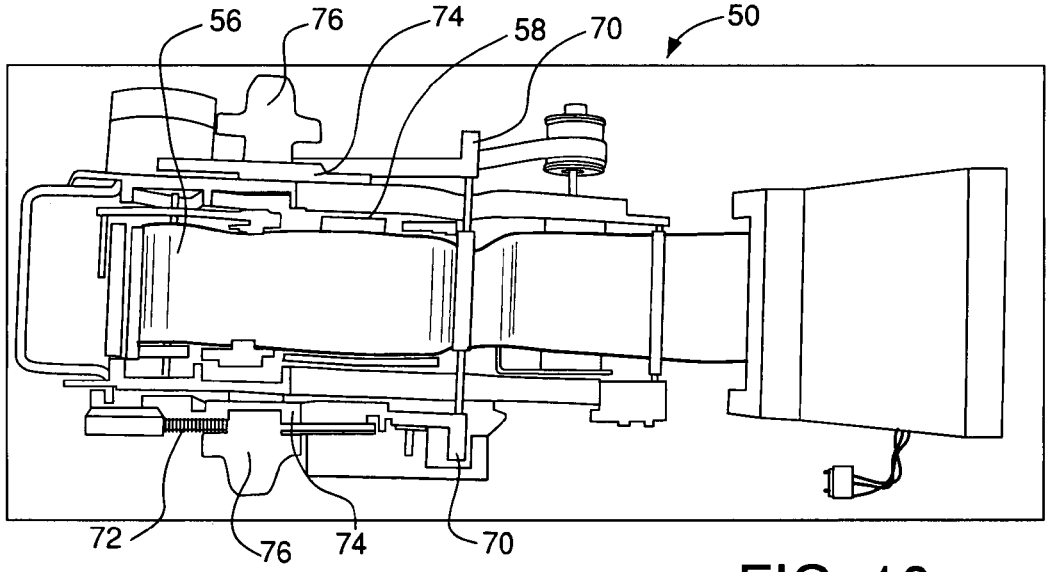
FIG. 10 is a top view of the printing mechanism with the tension arm in the ribbon loading position and the locking plates pivoted into the unlocked positions.

FIGS. 7 and 8 show tension arm 70 moved forward to the ribbon loading position. The shape of locking plates 74 prevents them from being moved to the unlocked positions prior to moving tension arm 70 to the ribbon loading position. FIGS. 9 and 10 show tension arm 70 in the ribbon loading position, and locking plates 74 moved to the unlocked positions. As shown, the configuration and shape of locking plates 74 hold tension arm 70 in the ribbon loading position with cam latches 76 holding locking plates 74 in the unlocked positions.

As best shown in FIGS. 11 and 12, spool slots 90 and 92 accommodate the ribbon spools and locking features 94 and 96 provide the positive spool locks.

In a preferred embodiment, ribbon tensioner arm 70 is provided with a sensor which is actuated only when the arm is in the ribbon loading position. This sensor is connected to the control electronics for print mechanism 50 and, when actuated, tells the electronics that the printer is not ready.

Therefore, an operator cannot remove ribbon spools until locking plates 74 are placed in the correct, released positions. This cannot occur until tensioner arm 70 is placed in the loading position. Once tensioner arm 70 is in the correct position, locking plates 74 can be opened, at which point, tensioner arm 70 is held in the correct position and cannot be moved, and the printer reports a status of not ready. Ribbon spools 56 and 58 may now be removed and replaced, but the printer cannot function. Only when locking plates 74 are returned to the locked positions, securing the ribbon spools, will the tensioner arm 70 be released and allowed to return to the working position. At this point, ribbon spools 56 and 58 are locked in place, and the sensor on tensioner arm 70 reports that tensioner arm 70 is in the working position and the printer is ready.

Figure 13:
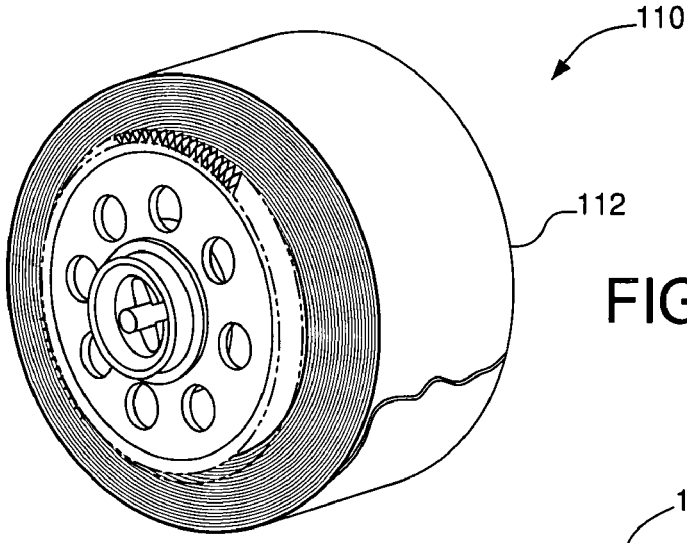
FIG. 13 is a perspective view of a hand-separable ribbon spool shaft assembly made in accordance with the invention, holding a spool of offset MICR encoding ribbon.
Figure 14:
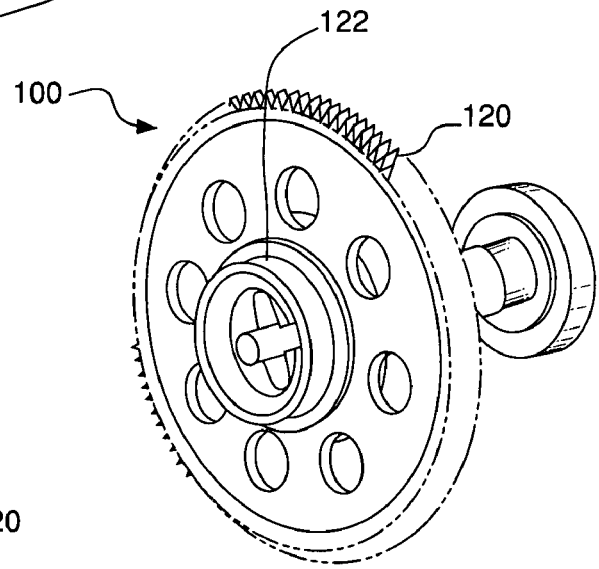
FIG. 14 is a perspective view of the spool shaft assembly.
Figure 15:
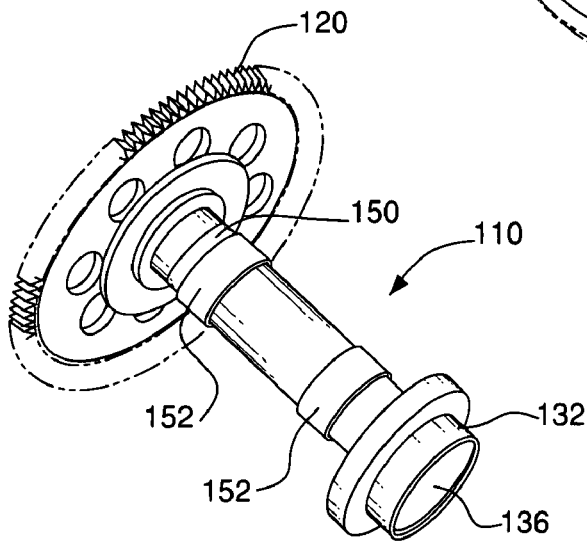
FIG. 15 is another perspective view of the spool shaft assembly.
Figure 16:
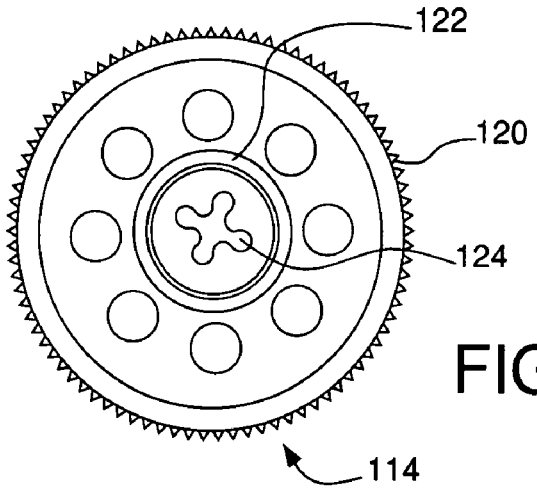
FIG. 16 is an end view of the driving shaft part, showing the drive gear.
Figure 17:
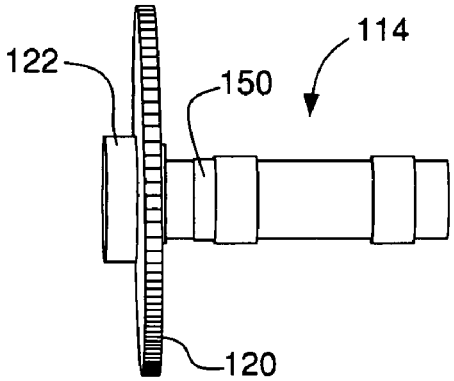
FIG. 17 is a side view of the driving shaft part.
Figure 18:
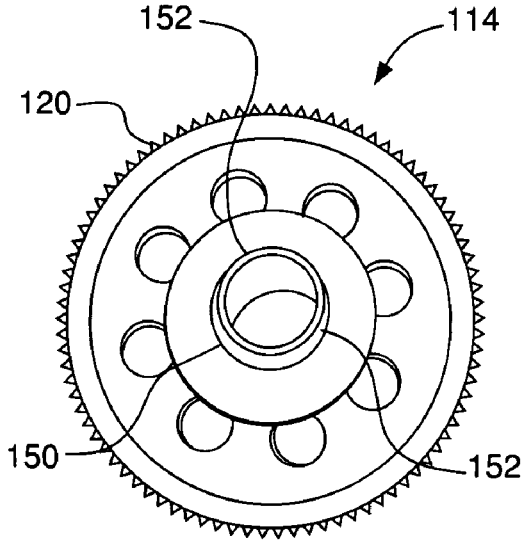
FIG. 18 is an end view of the other end of the driving shaft part.
Figure 19:
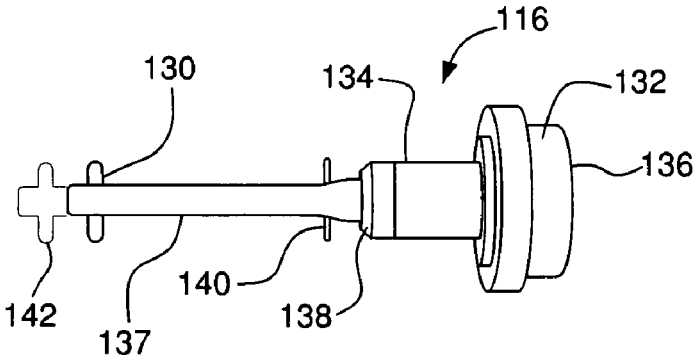
FIG. 19 is a side view of the other, cooperating shaft part, showing the push-and-turn function.

FIGS. 13-19 illustrate a preferred embodiment of the hand-separable ribbon spool shaft assembly which adapts a plain ribbon spool so as to provide drive and location functions. FIGS. 13-15 show the complete assembly at 110. The shaft assembly 110 holds a plain ribbon spool 112. The shaft assembly 110 includes a first, driving, shaft part 114, and a second, cooperating, shaft part 116. Driving shaft part 114 is best shown in FIGS. 16-18, while cooperating shaft part 116 is best shown in FIG. 19.

The two shaft parts 114, 116 are assembled to the ribbon spool 112 and cooperate to provide a manual hand-action locking mechanism for locking the shaft parts 114, 116 together when assembled to the ribbon spool 112.

Driving shaft part 114 includes gear drive means 120, and bearing/locating surface 122. The hand-separable function is provided by a push-and-turn arrangement built into the two-piece shaft assembly 110. As shown, end 130 of cooperating shaft part 116 extends through aperture 124 of driving shaft part 114, and this cooperation provides the locking mechanism for locking the shaft parts together.

As best shown in FIG. 19, cooperating shaft part 116 includes bearing/locating surface 132. Spring means enclosed within section 134 of shaft part 116 provides both the locking force for the push-and-turn function and the necessary lateral force to clamp the two shaft halves onto the ribbon spool to eliminate lateral tolerance variations.

End 136 may be pushed against the bias of the enclosed spring to urge body 137 forward, causing stop 138 to move to position 140. In the same way, end 130 is moved to position 142.

The shaft assembly 110 locates ribbon spool 112 radially and in all three axes of translation and provides the necessary rotational bearing and locating surfaces to position the ribbon spool correctly in a printing mechanism. In a printing mechanism, the shaft allows the ribbon spool to rotate to unwind/rewind correctly, and provides gear drive means to drive/retard the rotating ribbon spool.

Keying and locational features 150 and 152 on shaft part 114 provide positive one-way-only assembly function. Any attempt to assemble the ribbon spool in other than the correct orientation, or any incomplete assembly, will result in an assembly which cannot be completed and/or will not go into the printer mechanism for which it is designed.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A hand-separable ribbon spool shaft assembly for use in a high-speed encoding printer to adapt a plain ribbon spool so as to provide drive and location functions, the shaft assembly comprising:

a shaft assembly composed of at least two shaft parts that are assembled to the ribbon spool and cooperate to provide a manual hand-action locking mechanism for locking the shaft parts together when assembled to the ribbon spool, the shaft assembly having first and second ends outside the ends of the ribbon spool for providing bearing and locating surfaces when the shaft assembly is positioned in a receiving slot in the high-speed encoding printer; and a spring means enclosed within one of the shaft parts to provide the locking force for the push and turn arrangement and to provide lateral force to clamp the two shaft parts onto the ribbon spool to eliminate lateral tolerance variations;

wherein the bearing and locating surfaces allow the ribbon spool shaft assembly to rotate during operation of the printer, and wherein the assembly further includes a gear drive means on one of the shaft parts for driving the rotating ribbon spool;

the shaft assembly is composed of a first part and a second part, the first part including the gear drive means and the second part cooperating with the first part to lock the shaft parts together when assembled to the ribbon spool; and the locking mechanism is a push and turn arrangement.

2. The assembly of claim 1 farther comprising:

a plurality of keying and location features on the shaft parts to locate the ribbon spool when the shaft parts are assembled to the ribbon spool.

3. The assembly of claim 2 wherein the plurality of keying and location features is configured such that the shaft parts may only assemble to the ribbon spool in the appropriate orientation.

4. An improved printing mechanism in a high speed encoding printer of the type in which a plain ribbon spool holds print ribbon, the improvement comprising:

a shaft assembly composed of at least two shaft parts that are assembled to the ribbon spool and cooperate to provide a manual hand-action locking mechanism for locking the shaft parts together when assembled to the ribbon spool, the shaft assembly having first and second ends outside the ends of the ribbon spool for providing bearing and locating surfaces when the shaft assembly is positioned in a receiving slot in the high-speed encoding printer; and a spring means enclosed within one of the shaft parts to provide the locking force for the push and turn arrangement and to provide lateral force to clamp the two shaft parts onto the ribbon spool to eliminate lateral tolerance variations;

wherein the bearing and locating surfaces allow the ribbon spool shaft assembly to rotate during operation of the printer, and wherein the assembly further includes a gear drive means on one of the shaft parts for driving the rotating ribbon spool;

the shaft assembly is composed of a first part and a second part, the first part including the gear drive means and the second part cooperating with the first part to lock the shaft parts together when assembled to the ribbon spool; and the locking mechanism is a push and turn arrangement.

5. The printing mechanism of claim 4 further comprising:

a plurality of keying and location features on the shaft parts to locate the ribbon spool when the shaft parts are assembled to the ribbon spool.

6. The printing mechanism of claim 5 wherein the plurality of keying and location features is configured such that the shaft parts may only assemble to the ribbon spool in the appropriate orientation.

7. An apparatus comprising:

a document processing system including a feeder stage and a transport stage;

the feeder stage including a hopper assembly and a feeder wherein the feeder acts to feed documents singly, in order, from a stack of documents in the hopper assembly;

the transport stage being downstream of the feeder stage for receiving the fed documents;

the document processing system including a printing mechanism in a high speed encoding printer of the type in which a plain ribbon spool holds print ribbon;

a shaft assembly composed of at least two shaft parts that are assembled to the ribbon spool and cooperate to provide a manual hand-action locking mechanism for locking the shaft parts together when assembled to the ribbon spool, the shaft assembly having first and second ends outside the ends of the ribbon spool for providing bearing and locating surfaces when the shaft assembly is positioned in a receiving slot in the high-speed encoding printer; and a spring means enclosed within one of the shaft parts to provide the locking force for the push and turn arrangement and to provide lateral force to clamp the two shaft parts onto the ribbon spool to eliminate lateral tolerance variations;

wherein the bearing and locating surfaces allow the ribbon spool shaft assembly to rotate during operation of the printer, and wherein the assembly further includes a gear drive means on one of the shaft parts for driving the rotating ribbon spool;

the shaft assembly is composed of a first part and a second part, the first part including the gear drive means and the second part cooperating with the first part to lock the shaft parts together when assembled to the ribbon spool; and the locking mechanism is a push and turn arrangement.

8. The apparatus of claim 7 further comprising:

a plurality of keying and location features on the shaft parts to locate the ribbon spool when the shaft parts are assembled to the ribbon spool.

9. The apparatus of claim 8 wherein the plurality of keying and location features is configured such that the shaft parts may only assemble to the ribbon spool in the appropriate orientation.

* * * * *